US005787569A

United States Patent [19]

Lotfi et al.

[11] Patent Number: 5,787,569

[45] Date of Patent: Aug. 4, 1998

[54] ENCAPSULATED PACKAGE FOR POWER MAGNETIC DEVICES AND METHOD OF MANUFACTURE THEREFOR

[75] Inventors: Ashraf Wagih Lotfi, Rowlett, Tex.; John David Weld, Succasunna, N.J.; Karl Erich Wolf, Rockwall, Tex.; William Lonzo Woods, Kaufman, Tex.

[73] Assignee: Lucent Technologies Inc., Murray Hill, N.J.

[21] Appl. No.: 604,637

[22] Filed: Feb. 21, 1996

[51] Int. Cl.[6] ..... H01F 41/02

[52] U.S. Cl. ..... 29/602.1; 29/25.42; 29/855; 29/840; 264/272.17; 437/207; 437/214; 437/217; 53/122; 53/449

[58] Field of Search ..... 53/122, 170, 449, 53/474; 438/126; 264/272.17, 272.19; 29/25.42, 602.1, 606, 855, 827, 840; 437/207, 214, 217, 902

[56] References Cited

U.S. PATENT DOCUMENTS

| | | | |
|---|---|---|---|
| 4,916,522 | 4/1990 | Cohn | 357/72 |
| 5,187,860 | 2/1993 | Horibata et al. | 29/603 |
| 5,193,267 | 3/1993 | Satoh et al. | 29/602.1 X |
| 5,239,744 | 8/1993 | Fleming et al. | 29/602.1 |
| 5,299,097 | 3/1994 | Kondo et al. | 29/827 |
| 5,311,401 | 5/1994 | Gates, Jr. et al. | 361/760 |
| 5,313,365 | 5/1994 | Pennisi et al. | 361/760 |
| 5,317,300 | 5/1994 | Boesel | 336/96 |
| 5,318,095 | 6/1994 | Stowe | 164/112 |
| 5,328,870 | 7/1994 | Marrs | 29/827 |
| 5,331,730 | 7/1994 | Brinn, Jr. | 29/606 |
| 5,365,403 | 11/1994 | Vinciarelli et al. | 361/707 |
| 5,365,655 | 11/1994 | Rose | 29/827 |
| 5,384,286 | 1/1995 | Hirai | 29/827 |
| 5,414,928 | 5/1995 | Bonitz et al. | 29/840 |
| 5,428,885 | 7/1995 | Takaya et al. | 29/602.1 |
| 5,534,464 | 7/1996 | Ujiie | 29/855 |
| 5,551,146 | 9/1996 | Kawabata et al. | 29/602.1 X |
| 5,653,020 | 8/1997 | Romano et al. | 29/827 |

OTHER PUBLICATIONS

"Vacuum Impregnation of Wound Ferrite Components: Potential Problems and Pitfalls" by Jan M. van der Poel; Jan. 1981; from Insulation/Circuits; pp. 35–39.

"Magnetostriction Constants of Mn–Zn–Fe Ferrites" by Keizo Ohta and Natsuo Kobayashi; Jun. 20, 1964; Japanese Journal of Applied Physics, pp. 576–580.

Effect of uniaxial tensile stress on the permeability of monocrystalline $MnZnFe^{II}$ by E.G. Visser; Mar. 1984; 1984 American Institute of Physics; pp. 2251–2253.

"Effect on Hydrostatic Pressure on the Magnetization Mechanisms in Ni–Zn Ferrite" by Jean Loaec, Anatol Globus, Marcel Le Floc'h and Pierre Johannin; IEEE Transactions on Magnetics; Sep. 1975; pp. 1320–1322.

"Effect of Pressure on Soft Magnetic Materials" by M. Le Floc'h; J. Loaec; H. Pascard and A. Globus; IEEE Transactions of Magnetics; Nov. 1981; pp. 3129–3132.

"Magnetostriction of Ni–Zn Ferrites Containing Cobalt" by J. Kulikowski and A. Bienkowski; Journal of Magnetism and Magnetic Materials; 1982; pp. 297–299.

"The Effect of Stress on Some Properties of MnZn Ferrite" by E.C. Snelling; Apr. 6, 1974; pp. 616–618.

*Primary Examiner*—W. Donald Bray

[57] ABSTRACT

An encapsulated package for a power magnetic device and a method of manufacture therefor. The power magnetic device has a magnetic core subject to magnetostriction when placed under stress. The package includes: (1) compliant material disposed about at least a portion of the magnetic core and (2) an encapsulant substantially surrounding the compliant material and the magnetic core, the compliant material providing a medium for absorbing stress between the encapsulant and the magnetic core, the compliant material reducing the magnetostriction upon the magnetic core caused by the stress from the encapsulant. In one embodiment, the encapsulant includes a vent to an environment surrounding the package. The vent provides pressure relief for the compliant material, allowing the compliant material to substantially eliminate the magnetostrictive effects.

20 Claims, 8 Drawing Sheets

ENCAPSULATED PACKAGE FOR POWER MAGNETIC DEVICES AND METHOD OF MANUFACTURE THEREFOR

TECHNICAL FIELD OF THE INVENTION

The present invention is directed, in general, to electronics packaging and, more specifically, to a minimally magnetostrictive encapsulated module for magnetic structures that substantially eliminates effects due to magnetostriction and a method of manufacture therefor.

BACKGROUND OF THE INVENTION

A magnetic device uses magnetic material arranged to shape and direct magnetic flux in a predetermined manner to achieve a desired electrical performance. The magnetic flux provides a medium for storing, transferring or releasing electromagnetic energy.

Magnetic devices most typically comprise a core having a predetermined volume and composed of a magnetic material (e.g., ferrite) having a magnetic permeability greater than that of a surrounding medium (e.g., air). A plurality of windings of a desired number of turns and carrying an electrical current surround, excite and are excited by the core (or legs thereof). Because the magnetic core has a relatively high permeability, magnetic flux produced by the windings is confined almost entirely to the core. The flux follows the path the core defines; flux density is essentially consistent over the uniform cross-sectional area of the core.

Magnetic devices are often used to suppress electromagnetic interference ("EMI"). When used in the suppression role, the efficiency with which a magnetic device stores and releases electrical power is not usually a concern. However, magnetic devices are also frequently employed to transmit, convert or condition electrical power (so-called "power magnetic devices"). When so employed (often in the environment of power supplies for electronic equipment), magnetic performance and efficiency become major concerns.

As those of ordinary skill in the art understand, it is highly desirable to provide a protective, heat-dissipating package for electronic circuitry. Often, such circuitry can be encapsulated or "molded," wherein an encapsulant is formed about the circuitry to yield a unitary, board-mountable package. One well known configuration for board-mountable package is a so-called dual in-line package ("DIP"), wherein electrical leads protrude from opposing sidewalls of the package. The leads are advantageously so arranged to allow the package to be mounted to a circuit board by various conventional soldering processes. DIPs are widely used for packaging integrated circuits, most often in computer-related environments.

It has been long felt that power supplies would greatly benefit from such encapsulation. However, in the pursuit of producing encapsulated, board-mounted power supply packages, it was discovered that the normally effective prior art operation of encapsulating the power supply circuitry with a conventional thermosetting epoxy molding compound through a conventional transfer molding process seriously degraded the magnetic performance and efficiency of the magnetic devices within the circuitry, plunging the overall efficiency of the power supply well below an acceptable level.

In the past, two work-around "solutions" emerged to address this impasse. First, most prior art power supplies simply avoided the problem by remaining unencapsulated. Unfortunately, the power supply circuits were unable to take advantage of the physical protection and additional heat-dissipating capacity that encapsulation would have provided. Such unencapsulated power supplies were also difficult to mount on a circuit board due to a lack of suitable solder processes and handling surfaces.

Second, in those few prior art power supplies that were encapsulated, the magnetic devices were required to be grossly overrated by design. After encapsulation, the magnetic performance of the devices degraded as anticipated, but, by sole virtue of their initial gross overrating, remained above a minimum acceptable level. Obviously, this method caused a waste of material and space and suffered inefficiency. Further, this method utterly failed to address the fundamental degradation problem.

Accordingly, what is first needed in the art is an understanding of the underlying effect that occurs when power magnetic devices are encapsulated, causing the magnetic performance of the devices to degrade. Further, what is needed (once the effect is understood) is an encapsulated package for power magnetic devices and an associated highly economical and feasible method of manufacture for such packages that preserve magnetic performance by directly addressing the effect.

SUMMARY OF THE INVENTION

The underlying effect that occurs when power magnetic devices are encapsulated (causing the magnetic performance of the devices to degrade), is magnetostriction. Magnetostriction (and a related effect of strain pinning of the domain walls of the magnetic cores) have been found to be brought about by molding pressures and post-molding stresses on the magnetic cores within the power supply circuitry.

Magnetostriction in ferrites causes degradation of magnetic properties when they are placed under tensile or compressive stress. Magnetostriction and strain pinning causes the permeability of the ferrite core to decrease and coercivity of the ferrite core to increase. As a result, the electrical design of the power module circuit suffers from both reduced inductance values and reduced quality factors (e.g., higher core losses).

To address the above-discussed deficiencies of the prior art, and in light of the understanding of the related effects of magnetostriction and stress pinning, the present invention provides an encapsulated package for a power magnetic device and a method of manufacture therefor. The power magnetic device has a magnetic core subject to magnetostriction when placed under stress. The package includes: (1) compliant material disposed about at least a portion of the magnetic core and (2) an encapsulant substantially surrounding the compliant material and the magnetic core, the compliant material providing a medium for absorbing stress between the encapsulant and the magnetic core. The compliant material reduces the magnetostriction upon the magnetic core caused by the stress from the encapsulant.

In a preferred embodiment of the present invention, the encapsulant includes a vent to an environment surrounding the package, the vent providing pressure relief for the compliant material. In a manner to be described more fully, the vent allows magnetostriction to be substantially eliminated, rather than just reduced.

In a preferred embodiment of the present invention, a ratio of a diameter of the vent to the outer diameter of the magnetic core is at least 10%. In a more preferred embodiment, the ratio is about 25%.

In a preferred embodiment of the present invention, the compliant material is a room temperature vulcanizing ("RTV") silicone adhesive and sealant. In a related embodiment, the compliant material is a compressible material (e.g., low modulus material). Those of ordinary skill in the art will recognize that the compliance of the material is the most important characteristic for minimizing the effects of magnetostriction.

In a preferred embodiment of the present invention, the encapsulant is a thermosetting epoxy molding compound. Those of ordinary skill in the art are aware of the conventional use of such compound for encapsulating electronic circuitry.

In a preferred embodiment of the present invention, the package further comprises power supply circuitry coupled to the magnetic device and surrounded by the encapsulant, the package thereby being a power supply module. Thus, the magnetic device may form a portion of a power supply. In this environment, the present invention provides an encapsulated power supply module that may be mounted to a circuit board as easily and conventionally as any other electronic circuitry.

In a preferred embodiment of the present invention, the package further comprises electrical leads coupled to the power supply circuitry and protruding from the package to allow the package to be mounted to a circuit board. The leads are thus available for conventional soldering processes.

The foregoing has outlined, rather broadly, preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention in its broadest form.

BRIEF DESCRIPTION OF THE DRAWINGS

For a more complete understanding of the present invention, reference is now made to the following descriptions taken in conjunction with the accompanying drawings, in which.

DETAILED DESCRIPTION

Figure 1:
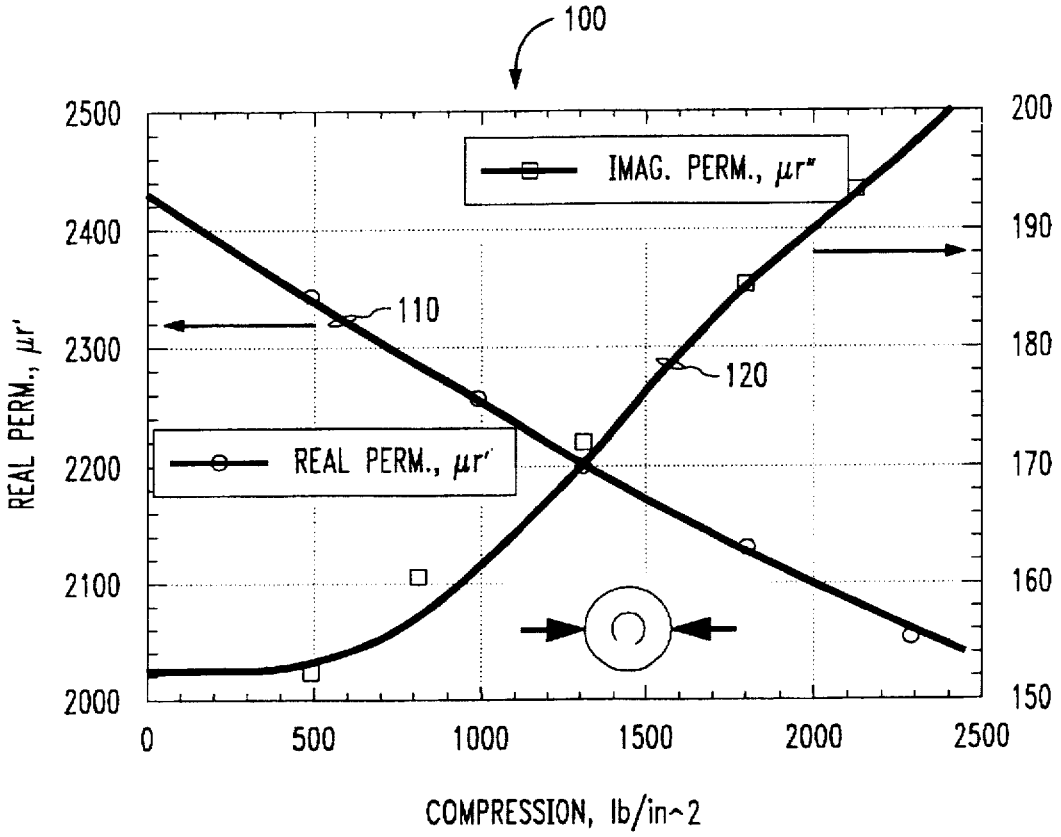
FIG. 1 illustrates a graphical representation of the complex permeability of a magnetic device under compressive stress.

Referring initially to FIG. 1, illustrated is a graphical representation 100 of the complex permeability of a magnetic device (not shown) under compressive stress. In high frequency switch-mode power modules (not shown), manganese zinc ("MnZn") ferrites are used as the core material in magnetic devices such as energy storage inductors and transformers. In these and other applications, the ferrite cores cannot be encapsulated with a rigid material since the resulting stress causes a loss of permeability and resulting core losses in both MnZn and nickel zinc ("NiZn") ferrites. Again, the compressive stress on the magnetic material causes a phenomenon called magnetostriction thereby causing an overall degradation of magnetic properties of the device. The saturation magnetostriction coefficient ("$\lambda_s$"), as an example, for most MnZn ferrites is $\approx -1\times10^{-6}$–$-5\times10^{-6}$ and for most NiZn ferrites (due to the presence of Ni) is $\approx -15\times10^{-6}$–$-20\times10^{-6}$. The addition of small amounts of Cobalt ("Co") can reduce $\lambda_s$.

To measure the level of magnetostriction in the MnZn ferrite, a toroidal-shaped magnetic core is subjected to external lateral and normal compressive forces. While toroidal ferrite cores are used in the illustrated embodiment for material measurements and characterization because of the symmetry, flux uniformity and consistent cross-sectional areas, magnetostrictive effects are equally applicable to other types of magnetic materials.

Complex permeability $\bar{\mu}=\mu'+j\mu''$ provides a criteria of characterizing a magnetic material because it is directly related to the electrical impedance of a winding on that core. It can be derived from a real permeability, $\mu'$ (represented by line 110), and an imaginary permeability, $\mu''$ (represented by line 120), of the impedance. The real permeability 110 corresponds to the inductance resulting from the magnetization available in the core. The imaginary permeability 120 measures the dissipation within the core material. The toroid core is subjected to variable pressure to fully characterize the stress dependence of the ferrite core. The variable pressure on the core results in changes in the complex permeability under dynamic conditions (e.g., 500 kilohertz ("Khz")). The drop in real permeability 110 is accompanied by an increase in the imaginary permeability 120, signaling a loss of inductance and an increase in core dissipation. Even under the smallest stress (<500 pounds per in$^2$ ("psi") or 34.5 bar), where core loss does not increase, permeability drops by 5%. However, the difference in the coefficient of thermal expansion (and contraction) induced stress over a wide range of operating temperatures is far greater (>2000 psi or 138 bar) leading to a drop of real permeability 110 in the range of 16%, a rise in imaginary permeability 120 of 32% and a substantial decrease in the overall permeability for the magnetic device. While the illustrated embodiment exhibits the stress dependence of complex permeability for a toroidal ferrite core, the same principles apply to any magnetic device under compressive stresses. Simply stated, the magnetostrictive effects on magnetic materials under stress induce unacceptable reductions of the magnetic properties in the magnetic device.

Figure 2:
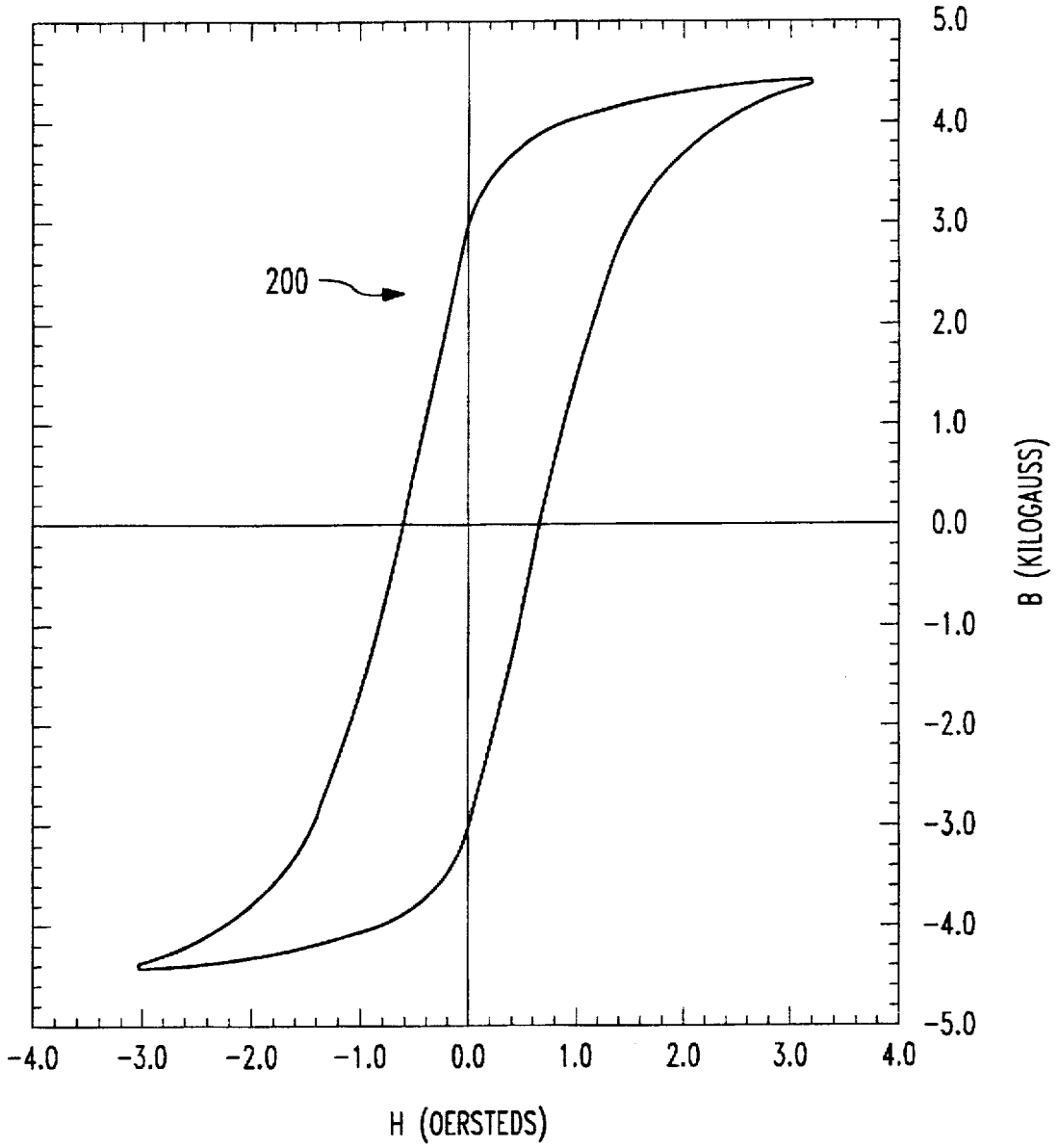
FIG. 2 illustrates a dynamic hysteresis loop of the magnetic device of FIG. 1 under substantially stress-free conditions.

Turning now to FIG. 2, illustrated is a dynamic hysteresis loop 200 of the magnetic device of FIG. 1 under relatively stress-free conditions. The hysteresis loop 200 demonstrates the steady-state relation between the magnetic induction in the magnetic material of the magnetic device and the steady-state alternating magnetic intensity that produces it. For each value of magnetizing force (in Oersteds ("Oe")) on the magnetic device, two values of magnetic flux density (in Gauss ("Gs")) are illustrated in the hysteresis loop 200. The illustrated embodiment demonstrates a 500 Khz hysteresis loop 200 with a 3 Oe drive into saturation. Under stress-free conditions, the amplitude permeability ("$\mu_p$") is 1424 and the coercivity ("$H^c$") is 0.64 Oe. The domains of the magnetic field, therefore, have been completely aligned resulting in a maximum flux density of 4430 Gs.

Figure 3:
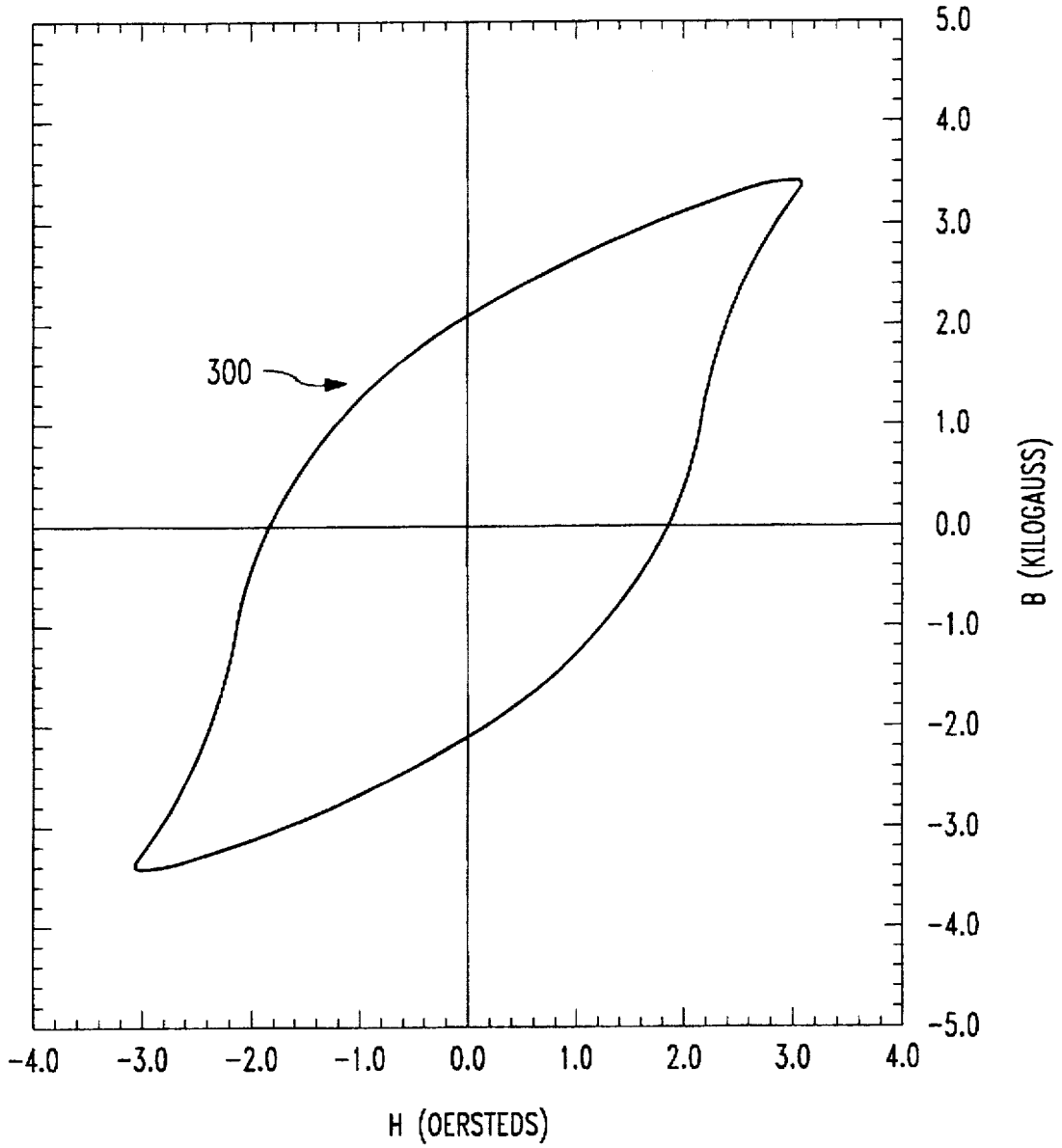
FIG. 3 illustrates a dynamic hysteresis loop of the magnetic device of FIG. 1 molded in a thermosetting epoxy molding compound and placed under compressive stress.

Turning now to FIG. 3, illustrated is a dynamic hysteresis loop 300 of the magnetic device of FIG. 1 molded in a thermosetting epoxy molding compound and placed under compressive stress. The magnetic device is illustrated as being molded in a thermosetting epoxy molding compound at 170° Celsius ("C.") and subsequently cooled to room temperature. The thermally-induced stress is established and, as displayed in the illustrated embodiment, the hysteresis loop 300 is deformed. Under these conditions, the amplitude permeability is 1100 and the coercivity has increased 3-fold to 1.85 Oe, indicating large strain energy that induces significant domain wall pinning. Under the same driving field of 3 Oe, complete alignment of domains is no longer possible since the maximum flux density is only 3381 Gs. The excessive stress, therefore, limits alignment of the domains to 76% and increases core dissipation to virtually 45% higher than the original state.

Figure 4:
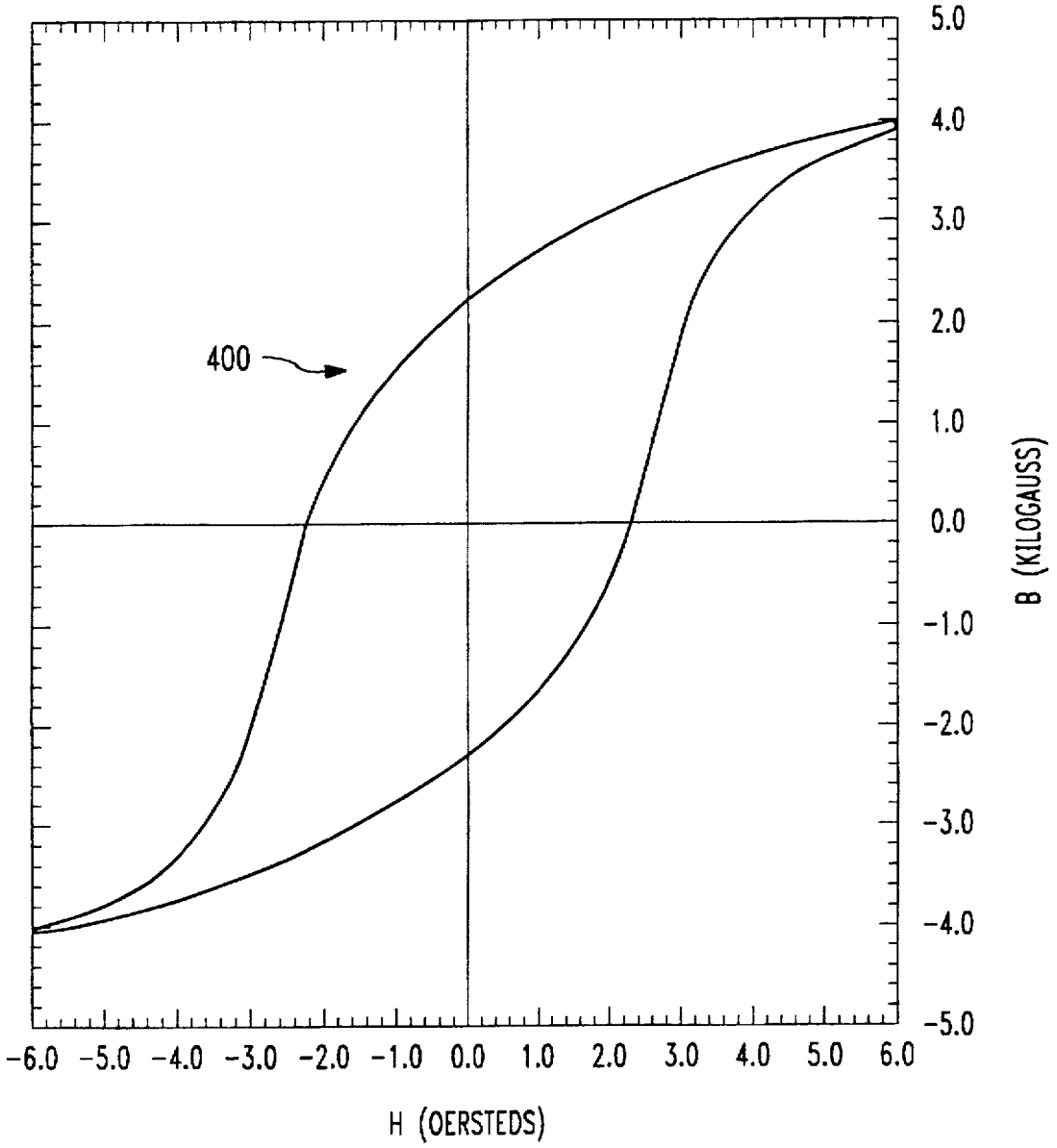
FIG. 4 illustrates a dynamic hysteresis loop of the magnetic device of FIG. 1 compensating for the losses associated with the conditions of FIG. 3.

Turning now to FIG. 4, illustrated is a dynamic hysteresis loop 400 of the magnetic device of FIG. 1 compensating for the losses associated with the conditions of FIG. 3. In the illustrated embodiment, the field drive of the magnetic device is doubled to align the remaining pinned domains left unaligned from the conditions described regarding FIG. 3. Alignment is limited to only 92%, resulting in an increased core dissipation of 108%. This outcome demonstrates the magnitude of external energy needed to overcome the strain energy barrier. Clearly, it is not practical to design a magnetic device to compensate for these unacceptable losses and the energy necessary to overcome these losses is intolerable.

Therefore, before it becomes practical to encapsulate power modules in thermosetting epoxy molding compounds, it is necessary to determine methods of protecting the ferrite cores of magnetic devices. In connection with the ultimate goal, several criteria are preferably be met. First, the magnetic properties of the magnetic device should be preserved through the post-molded stress relief period as it cools from the molding temperature to room temperature. Second, the thermal characteristics of the magnetic device required to operate efficiently over a specified range should be maintained. Finally, manufacturing costs should be maintained at a competitive level.

Figure 5A:
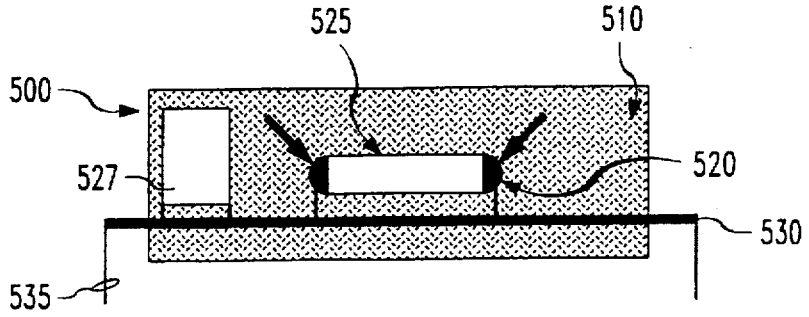
FIG. 5A illustrates a sectional view of a power module.

Turning now to FIG. 5A, illustrated is a sectional view of a power supply module 500. The power supply module 500 is board-mounted and includes an epoxy molded encapsulant 510 surrounding a magnetic core 525 of a power magnetic device 520 and power supply circuitry 527, coupled to the power magnetic device 520. Molded plastic packages for conventional integrated circuits are obviously not a new notion, but applying molded plastic packages to board-mounted power modules 500, for the aforementioned reasons, offers unique challenges.

The typical process comprises attaching a printed wiring board ("PWB") substrate to a lead frame (not shown), inserting the PWB assembly 530 into a mold and flowing heated epoxy molding compound or encapsulant 510 over the components, thereby providing complete encapsulation. After removing the molded power supply module 500 from the heated mold, the magnetic core 525 of the power magnetic device 520 experiences increasing stress as the molded power supply module 500 cools to room temperature and the epoxy molding compound 510 shrinks around the magnetic core 525 of the power magnetic device 520. The shrinkage around the magnetic core 525 creates the stress therein. The stress induces magnetostrictive effects, causing the power supply module 500 not to perform as designed. Although the velocity pressure head of the molding compound flow front and the static packing pressure vary from 40–50 psi and 350–500 psi, respectively, during the molding process, they do not solely create a large enough stress on the magnetic core 525 of the power magnetic device 520 to induce magnetostrictive effects. The major stress on the power magnetic device 520 occurs during the cooling period after molding. The stress is produced by the differences in the coefficient of thermal expansion ("CTE") between the epoxy molding compound 510 and the magnetic material of the power magnetic device 520. The amount of stress on the power magnetic device 520 is approximately 13,000 psi on some portions of the magnetic core 525 and three times that value in the corners of the magnetic core 525. The large increase in stress in the corners of the magnetic core 525 is generated from the sharp radii of the corners.

The power supply module 500 further includes electrical leads 535 coupled to the power supply circuitry 527 and protruding from opposing sidewalls of the power supply module 500 to allow the power supply module 500 to be mounted to a circuit board (not shown). The leads are thus available for conventional soldering processes.

Figure 5B:
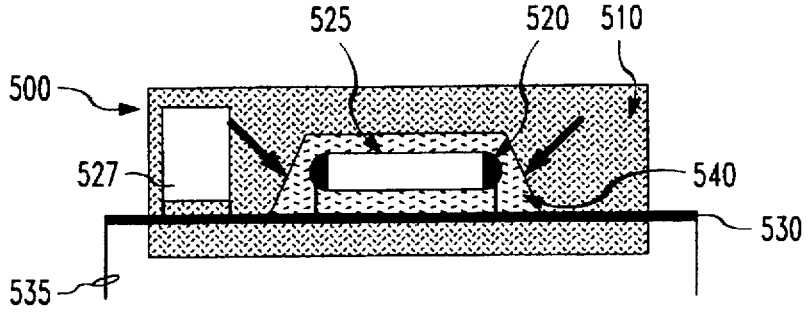
FIG. 5B illustrates a sectional view of the power module of FIG. 5A employing a compliant material.

FIG. 5B illustrates a sectional view of the power supply module 500 of FIG. 5A employing a compliant material 540. Again, the power supply module 500 is board-mounted and includes the encapsulant 510 surrounding the magnetic core 525 of the power magnetic device 520 and the power supply circuitry 527, coupled to the power magnetic device 520. Additionally, the power supply module 500 includes the stress-reducing, compliant material 540 that surrounds the magnetic core 525 and is thereby located between the magnetic core 525 and the encapsulant 510. In the illustrated embodiment, the compliant material 540 is a non-slumping, non-corrosive, single component, room temperature vulcanizing ("RTV") silicone adhesive and sealant that is placed on the magnetic core 525 prior to the encapsulant 510. The compliant material 540 is similar to Ultra Black 598 (Durometer, shore A=33, CTE=289 ppm), commercially available from the Loctite Corporation. Any compliant material, including compressible fluids (such as air), are well within the scope of the present invention. The compliant material 540 in conjunction with the encapsulant 510 provides an encapsulated package for the power magnetic device 520.

One desirable property of RTV silicone adhesive and sealant is that it provides strong adherence to the PWB assembly 530 and the power magnetic device 520 thereby preventing any molding compound from flowing onto the magnetic core 525 of the power magnetic device 520. Moreover, the low modulus of the compliant material 540 allows deformation in the direction of openings in the molding compound or encapsulant 510 or in air voids in the compliant material 540 or between the compliant material 540 and the magnetic core 525, thus removing the stress on the magnetic core 525 and transforming the stress into elastic strain. Additionally, a compliant material 540 such as the RTV silicone adhesive and sealant readily creeps under stress further reducing the stress on the magnetic core 525. Finally, the compliant material 540 may also undergo stress relaxation, thus further relieving the stress on the magnetic core 525.

Again, the power supply module 500 includes the electrical leads 535 coupled to the power supply circuitry 527 and protruding from opposing sidewalls of the power supply module 500 to allow the power supply module 500 to be mounted to a circuit board (not shown). The leads are thus available for conventional soldering processes.

Figure 5C:
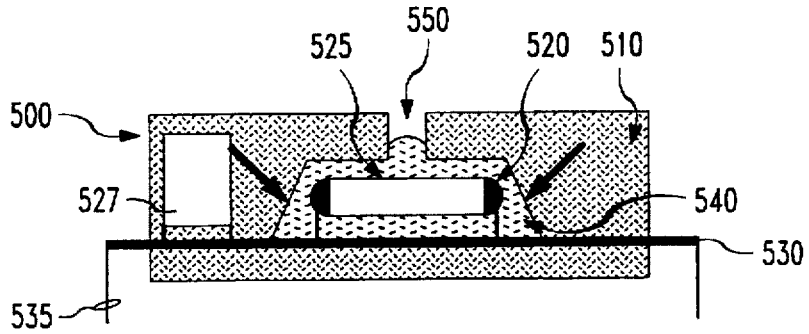
FIG. 5C illustrates a sectional view of the power module of FIG. 5A employing the compliant material of FIG. 5B and including a vent.

FIG. 5C illustrates a sectional view of the power supply module 500 of FIG. 5A employing the compliant stress reducing material 540 of FIG. 5B and, also, employing a vent 550. Again, the power supply module 500 is board-mounted and includes the encapsulant 510 surrounding the magnetic core 525 of the power magnetic device 520 and the power supply circuitry 527, coupled to the power magnetic device 520. Additionally, the power supply module 500 includes the stress-reducing, compliant material 540, surrounding the power magnetic device 520 between the magnetic core 525 and the encapsulant 510, and the vent 550. Stress avoidance is enhanced by covering the power magnetic device 520 with the compliant material 540 that is allowed to deform through the vent 550 to an environment surrounding the power magnetic device 520 as required during thermal excursions. The compliant material 540 in conjunction with the encapsulant 510 provides an encapsulated package for the power magnetic device 520. The vent 550 is centered above the magnetic core 525 of the power magnetic device 520 for optimum performance although the vent 550 can be offset and still achieve significant stress relief. While the vent 550 is illustrated as a single vent, it should be understood that multiple vents are well within the scope of the present invention.

Again, the power supply module 500 includes the electrical leads 535 coupled to the power supply circuitry 527 and protruding from opposing sidewalls of the power supply module 500 to allow the power supply module 500 to be mounted to a circuit board (not shown). The leads are thus available for conventional soldering processes.

Figure 6:
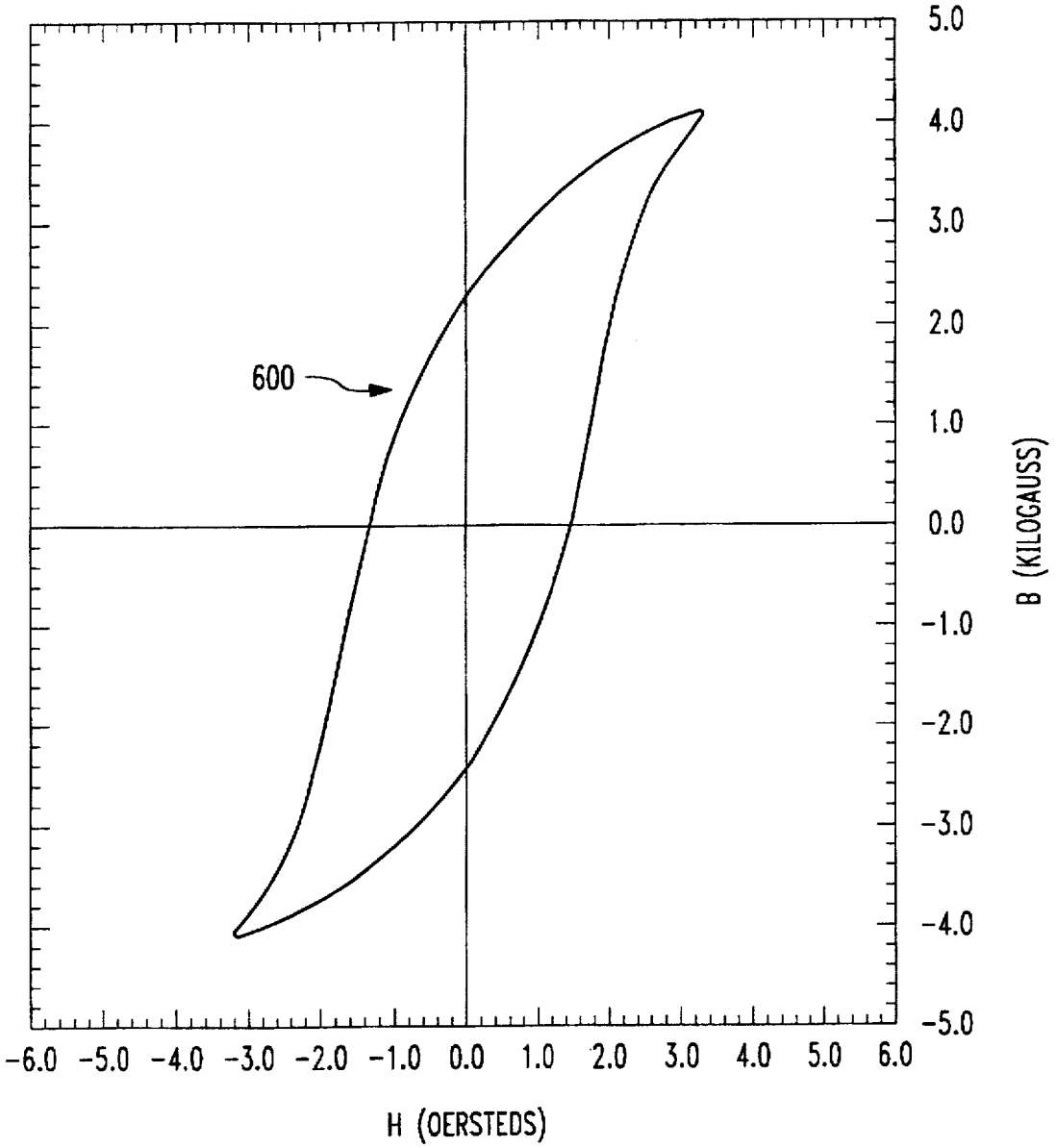
FIG. 6 illustrates a dynamic hysteresis loop of the magnetic device of FIG. 5B under compressive stress.

Turning now to FIG. 6, illustrated is a dynamic hysteresis loop 600 of the power magnetic device 520 of FIG. 5B under compressive stress. With the addition of the compliant material 540 surrounding the magnetic core 525 between the magnetic core 525 and the encapsulant 510, the compressive stress is significantly reduced leading to a substantial performance upgrade in the power magnetic device 520. Under the reduced stress condition, the amplitude of permeability is 1250 and the coercivity is 1.43 Oe. While complete domain alignment is not achieved, the maximum flux density is 4075 Gs and the alignment is 92% of the magnetic moment. As compared with the unprotected molding compound encapsulation (as illustrated with respect to FIG. 3), the increase in magnetic performance by the power magnetic device 520 is significant. The compliant material 540, by virtue of its low modulus, alleviates the compressive stress on the magnetic core 525 of the power magnetic device 520.

Figure 7:
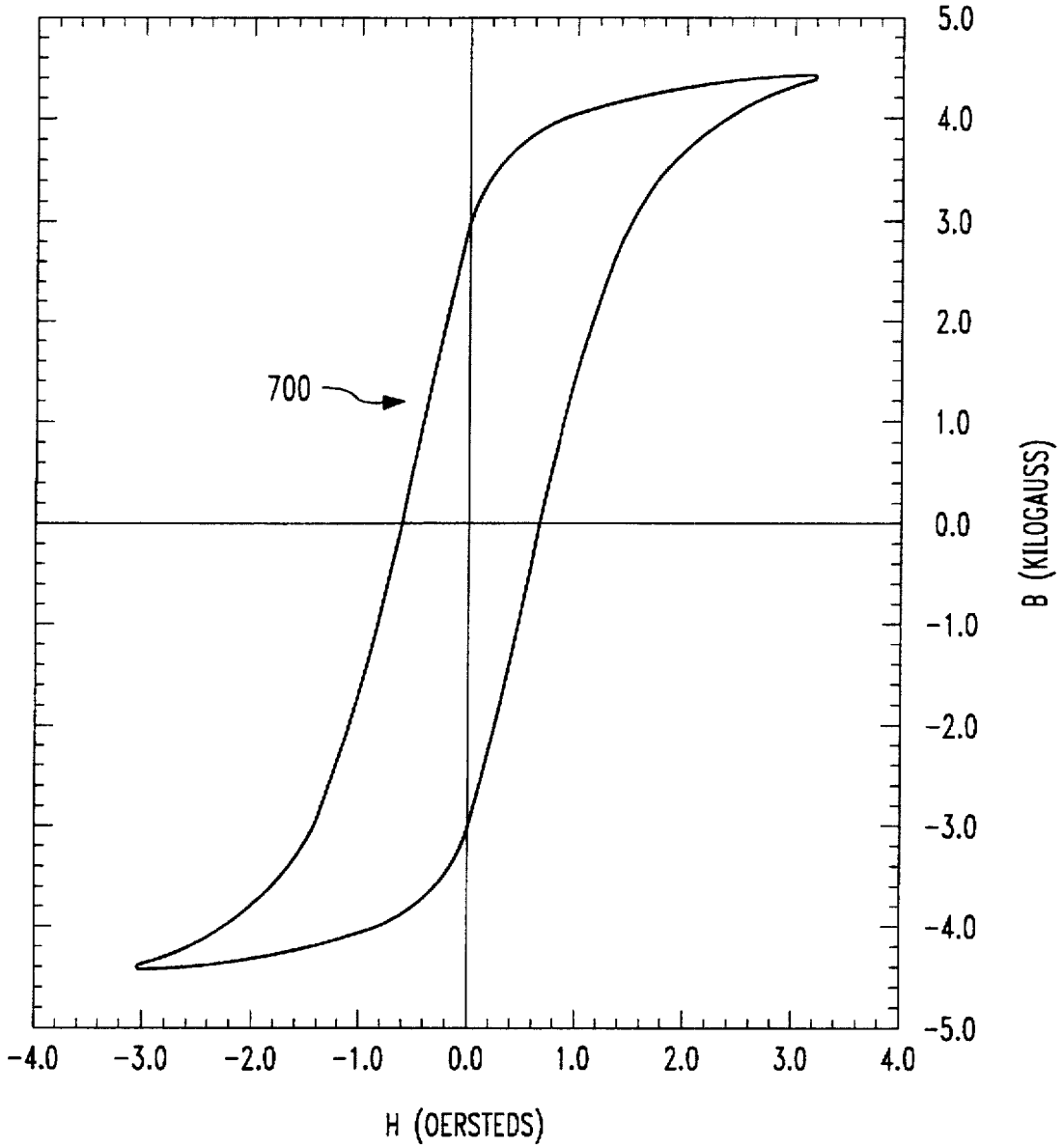
FIG. 7 illustrates a dynamic hysteresis loop of the magnetic device of FIG. 5C under compressive stress.

Turning now to FIG. 7, illustrated is a dynamic hysteresis loop 700 of the power magnetic device 520 of FIG. 5C under compressive stress. With the addition of the vent 550 in conjunction with the compliant material 540 surrounding the magnetic core 525 of the power magnetic device 520, the compressive stress is, even further, significantly reduced leading to a substantial performance upgrade in the power magnetic device 520. The vent 550 diameter in this case is approximately equal to the outer diameter of the magnetic core 525 of the power magnetic device 520. The dynamic hysteresis loop 700 indicates a full recovery and elimination of the stress on the power magnetic device 520.

Figure 8:
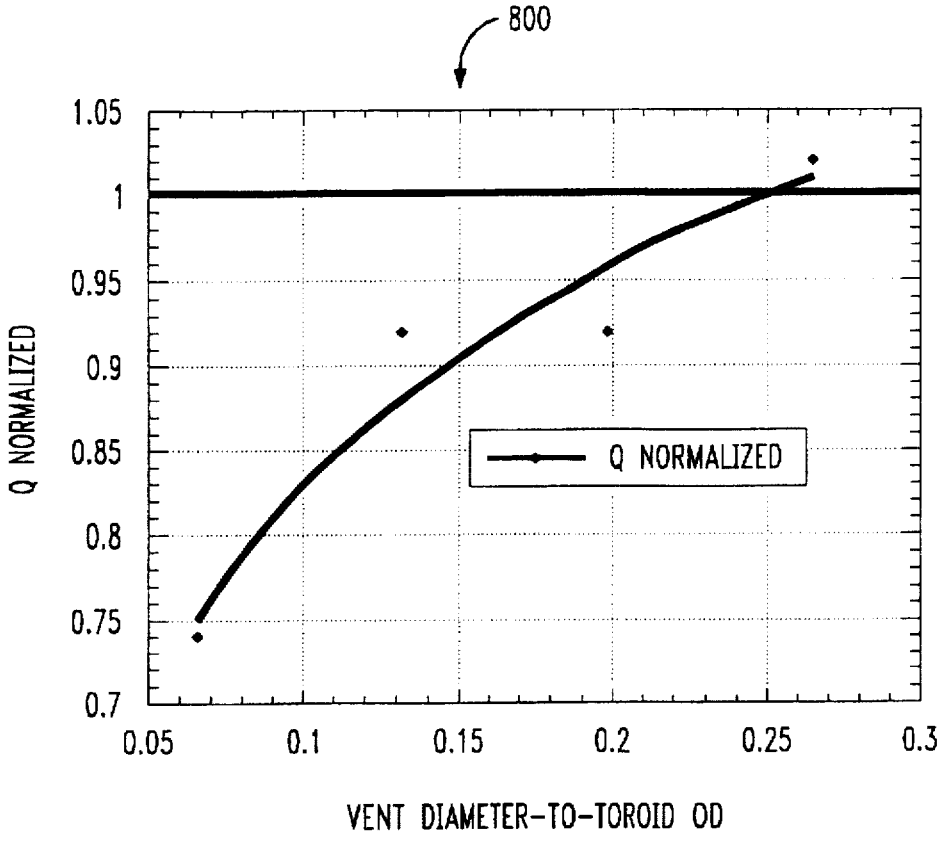
FIG. 8 illustrates a graphical representation of optimum vent diameter associated with the power module of FIG. 5C.

Turning now to FIG. 8, illustrated is a graphical representation 800 of the optimum vent 550 diameter associated with FIG. 5C. The graphical representation 800 plots the vent 550 diameter verses a normalized quality ("Q") factor during test conditions of 100° C. As the diameter is made progressively larger, the stress relief increases until it was complete. As demonstrated in the illustrated embodiment, for full performance recovery at 100° C., the ratio of vent 550 diameter to magnetic core 525 outer diameter is 25%. However, vent 550 diameters of at least 10% of the magnetic core 525 outer diameter may yield acceptable results.

Although the present invention has been described in detail, those skilled in the art should understand that they can make various changes, substitutions and alterations herein without departing from the spirit and scope of the invention in its broadest form.

What is claimed is:

1. An encapsulated package for a power magnetic device, said power magnetic device having a magnetic core subject to magnetostriction when placed under stress, said package comprising:

compliant material disposed about at least a portion of said magnetic core; and an encapsulant substantially surrounding said compliant material and said magnetic core, said compliant material providing a medium for absorbing stress between said encapsulant and said magnetic core, said compliant material reducing said magnetostriction upon said magnetic core caused by said stress from said encapsulant.

2. The package as recited in claim 1 wherein said encapsulant includes a vent to an environment surrounding said package, said vent providing pressure relief for said compliant material.

3. The package as recited in claim 2 wherein a ratio of a diameter of said vent to an outer diameter of said magnetic core is at least 10%.

4. The package as recited in claim 1 wherein said compliant material is a room temperature vulcanizing (RTV) silicone adhesive and sealant.

5. The package as recited in claim 1 wherein said compliant material is a compressible material.

6. The package as recited in claim 1 wherein said encapsulant is a thermosetting epoxy molding compound.

7. The package as recited in claim 1 further comprising power supply circuitry coupled to said magnetic device and surrounded by said encapsulant, said package thereby being a power supply module.

8. A method of manufacturing an encapsulated package for a power magnetic device, said power magnetic device having a magnetic core subject to magnetostriction when placed under stress, said method comprising the steps of:

disposing a compliant material about at least a portion of said magnetic core; and substantially surrounding said compliant material and said magnetic core with an encapsulant, said compliant material providing a medium for absorbing stress between said encapsulant and said magnetic core, said compliant material reducing said magnetostriction upon said magnetic core caused by said stress from said encapsulant.

9. The method as recited in claim 8 further comprising the step of providing pressure relief for said compliant material through a vent to an environment surrounding said package.

10. The method as recited in claim 9 wherein a ratio of a diameter of said vent to an outer diameter of said magnetic core is at least 10%.

11. The method as recited in claim 8 wherein said compliant material is a room temperature vulcanizing (RTV) silicone adhesive and sealant.

12. The method as recited in claim 8 wherein said compliant material is a compressible material.

13. The method as recited in claim 8 wherein said encapsulant is a thermosetting epoxy molding compound.

14. The method as recited in claim 8 further comprising power supply circuitry coupled to said magnetic device and surrounded by said encapsulant, said package thereby being a power supply module.

15. An encapsulated power supply module, said module including a power magnetic device having a magnetic core subject to magnetostriction when placed under stress, said module comprising:

power supply circuitry, coupled to said magnetic device, for converting electrical power;

compliant material disposed about at least a portion of said magnetic core; and an encapsulant substantially surrounding said compliant material, said magnetic core and said power supply circuitry, said encapsulant forming a vent to an environment surrounding said package, said compliant material providing a medium for absorbing stress between said encapsulant and said magnetic core, said vent providing pressure relief for said compliant material, said compliant material substantially eliminating said magnetostriction upon said magnetic core caused by said stress from said encapsulant.

16. The module as recited in claim 15 wherein a ratio of a diameter of said vent to an outer diameter of said magnetic core is at least 10%.

17. The module as recited in claim 15 wherein said compliant material is a room temperature vulcanizing (RTV) silicone adhesive and sealant.

18. The module as recited in claim 15 wherein said compliant material is a compressible material.

19. The module as recited in claim 15 wherein said encapsulant is a thermosetting epoxy molding compound.

20. The module as recited in claim 15 further comprising electrical leads coupled to said power supply circuitry and protruding from opposing sidewalls of said module to allow said module to be mounted to a circuit board.

* * * * *